US005155970A

United States Patent [19]

Moore

[11] Patent Number: 5,155,970

[45] Date of Patent: Oct. 20, 1992

[54] METHOD AND APPARATUS FOR STRETCH WRAPPING A LOAD USING A FILM WEB REVERSING TECHNIQUE

[75] Inventor: Phil Moore, Mount Washington, Ky.

[73] Assignee: Lantech, Inc., Louisville, Ky.

[21] Appl. No.: 701,841

[22] Filed: May 17, 1991

[51] Int. Cl.[5] ..... B65B 11/04

[52] U.S. Cl. ..... 53/399; 53/441; 53/556; 53/587; 53/588

[58] Field of Search ..... 53/399, 441, 211, 465, 53/556, 587, 588, 141

[56] References Cited

U.S. PATENT DOCUMENTS

| | | | |
|---|---|---|---|
| 2,286,267 | 6/1942 | Farny | 217/1 |
| 3,524,779 | 8/1970 | Masters et al. | 156/190 |
| 4,178,734 | 12/1979 | Lancaster | 53/399 |
| 4,302,920 | 12/1981 | Lancaster | 53/587 |
| 4,343,132 | 8/1982 | Lawless | 53/399 |
| 4,409,776 | 10/1983 | Usui | 53/399 |
| 4,723,393 | 2/1988 | Silbernagel | 53/556 |
| 4,726,172 | 2/1988 | Widenback | 53/399 |
| 4,735,033 | 4/1988 | Stackhouse | 53/441 X |
| 4,866,909 | 9/1989 | Lancaster | 53/556 |

*Primary Examiner*—John Sipos

*Attorney, Agent, or Firm*—Finnegan, Henderson, Farabow, Garrett & Dunner

[57] ABSTRACT

A method and apparatus for stretch wrapping a load with a film web having a tacky surface and a non-tacky surface. The film web is wrapped around the load in a forward direction with the tacky surface facing away from the load. The orientation of the film web is reversed by inserting a metal rod in the path of the film web and reversing the wrapping direction. The film web wraps around the metal rod, thereby causing the film web to fold back on itself. The film web is wrapped around the load in the reverse direction to cover the film web which was wrapped in the forward direction, with the tacky side facing the film web which was wrapped in the forward direction.

16 Claims, 7 Drawing Sheets

METHOD AND APPARATUS FOR STRETCH WRAPPING A LOAD USING A FILM WEB REVERSING TECHNIQUE

BACKGROUND OF THE INVENTION

1. Field of the Invention

The present invention relates to stretch wrapping and, more particularly, a method and apparatus for reversing the orientation of a film web while stretch wrapping a load.

2. Description of the Related Art

In stretch wrapping, a plastic film web is wrapped around a load in a stretched condition to create a package. The film web may have a tacky surface and a non-tacky surface. The film web is wrapped around the load in a spiral pattern such that portions of the film web overlap one another. The adhesiveness of the tacky surface causes the overlapped portions of the spirally wrapped film web to adhere to each other, thereby creating a stronger package.

It is undesirable to wrap the load with the tacky surface of the film web contacting the load, because the film web may adhere to the load. If the film web adheres to the load, it may damage the load upon removal. However, it is also undesirable to have the tacky surface of the film web facing away from the load and forming the outer surface of the package, because the tacky outer surface can make the package harder to handle. To avoid these problems, the film web is wrapped around the load with the tacky surface of the film web facing away from the load, the orientation of the film web is reversed, and the film web is wrapped around the load with the tacky surface facing toward the load. This method of wrapping places a non-tacky surface in contact with the load while allowing a non-tacky surface to form the outer surface of the package.

U.S. Pat. No. 4,409,776 to Usui, incorporated herein by reference, discloses a method and apparatus for wrapping goods with a stretched film web. In Usui, the load is spirally wrapped with an adhesive surface of the film web facing away from the load. After the entire load is covered, a film web supporting frame is inverted, thereby twisting the film web to reverse the orientation of the film web. The film web is then wrapped with the adhesive surface facing inward toward the load and the non-adhesive surface facing outward.

SUMMARY OF THE INVENTION

An object of the invention is to provide an improved method and apparatus for stretch wrapping by which the orientation of a film web may be reversed during the application of the film web to a load.

Another object of the present invention is to provide an improved method and apparatus for stretch wrapping by which a film web, having a tacky surface and a non-tacky surface, can be wrapped around a load such that the non-tacky surface contacts the load and also forms the outer surface of the package.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus for stretch wrapping a load. Means are provided for dispensing a film web onto the load. Means also are provided for moving the load relative to the dispensing means in a first rotational direction and a second rotational direction, opposite to the first rotational direction, for allowing the film web to be wrapped around the load with a first side of the film web facing away from the load, and for allowing the film web to be wrapped around the load with the first side o the film web facing toward the load. In addition, means are provided for restraining the film web so that the wrapping direction may be reversed.

It is to be understood that this general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Figure 2:
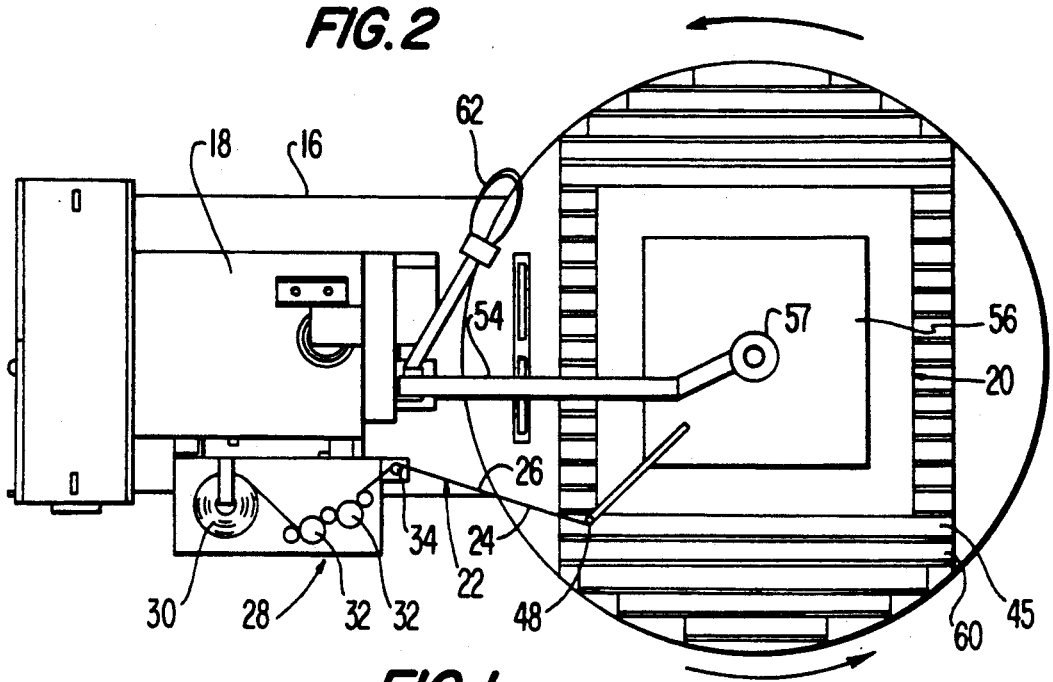
FIG. 2 is a plan view of the embodiment of FIG. 1.

Reference will now be made in detail to the presently preferred embodiments of the invention, examples of which are illustrated in the accompanying drawings. Wherever possible, similar reference numbers will be used to refer to similar parts.

The apparatus and method of the present invention are directed toward stretch wrapping a load with a film web to form a package. The film web preferably has a tacky surface and a non-tacky surface.

In accordance with the invention, the stretch wrapping apparatus of the present invention includes means for dispensing the film web onto the load, means for moving the load relative to the dispensing means in a first rotational direction and a second rotational direction, and means for restraining the film web so that the wrapping direction may be reversed.

The invention will be further illustrated by the following examples, which are intended to be purely exemplary of the invention.

A first embodiment of the invention is shown in FIGS. 1-5. In the first embodiment, the film web 22 is dispensed to be wound on a rotating load 20, while a web dispenser including roll carriage 28 moves in a direction substantially parallel to the axis of rotation of the load 20 to cause the film web 22 to be wrapped in a spiral pattern. Other examples of this type of machine are shown in U.S. Pat. Nos. 4,302,920 and 4,735,033 which are incorporated herein by reference.

The apparatus of the present invention includes a base 16 and a stanchion 18. A conveyor 60 extends over the base 16 to convey the load 20 into the wrapping area. A wipe down mechanism 62 with looped plastic strips extends from the stanchion 18 and is provided to press the trailing end of a severed film web 22 against the load 20.

As embodied herein, the means for dispensing the film web 22 onto the load 20 includes a roll carriage 28 having a film web supply roll 30, prestretch rollers 32, and a guide roller 34. Guide roller 34 may include a load cell for detecting the force on the film web and transmitting that information to the film dispensing mechanism to compensate for the variation in film demand by a noncircular load. In use, the film web 22 extends from the film web supply roll 30, through the group of prestretch rollers 32, about the guide roller 34, and onto the load 20.

In this embodiment, means are provided for moving the dispensing means in a direction substantially parallel to the axis of rotation of the load 20 to permit the film web to be spirally wrapped on the load. Preferably the means for moving the dispensing means includes two belts 36 connected to roll carriage 28 which are driven by a motor 38 to convey the roll carriage 28 in a direction substantially parallel to the axis of rotation of the load 20.

As embodied herein, the means for rotating the load 20 relative to the dispensing means includes a motor driven turntable 45 which is a segment of conveyor 60. Turntable 45 is capable of rotating the load 20 in a first rotational direction and in an opposing second rotational direction.

As embodied herein, the restraining means comprises a restraining member 48 for engaging the surface of the film web 22 which faces away from the load 20 and means for selectively positioning the restraining member 48 adjacent the surface of the film web 22 which faces away from the load 20. Preferably the restraining member 48 is a metal rod extending substantially parallel to the axis of rotation of turntable 45 in a direction substantially perpendicular to the dispensing direction of the film web 22.

As embodied herein, the means for selectively positioning the restraining member 48 includes a motor 50, a belt 52, a horizontally extending arm 54, and a top platen 56. The horizontally extending arm 54 is rotatably connected to a connecting rod 58 by a bearing 57. The connecting rod 58 projects upwardly from the platen 56. The rotatable connection between the connecting rod 58 and the horizontally extending arm 54 allows the restraining member 48 and the platen 56 to rotate in unison with the load 20 when in contact therewith. The horizontally extending arm 54 is slidably mounted on stanchion 51 and attached to belt 52 which is driven by motor 50. Actuation of the motor 50 conveys platen 56 and restraining member 48 in a direction substantially perpendicular to the dispensing direction of the film web 22.

A first alternative to this embodiment is to mount the restraining member on a rodless cylinder which in turn is mounted on a top platen. The rodless cylinder can be actuated to move the restraining member in a vertical direction so that the restraining member can be extendable from the top platen so as to be selectively positioned in or out of the path of the film web. A second alternative is to employ an arrangement for the restraining member which does not include a top platen.

Figure 1:
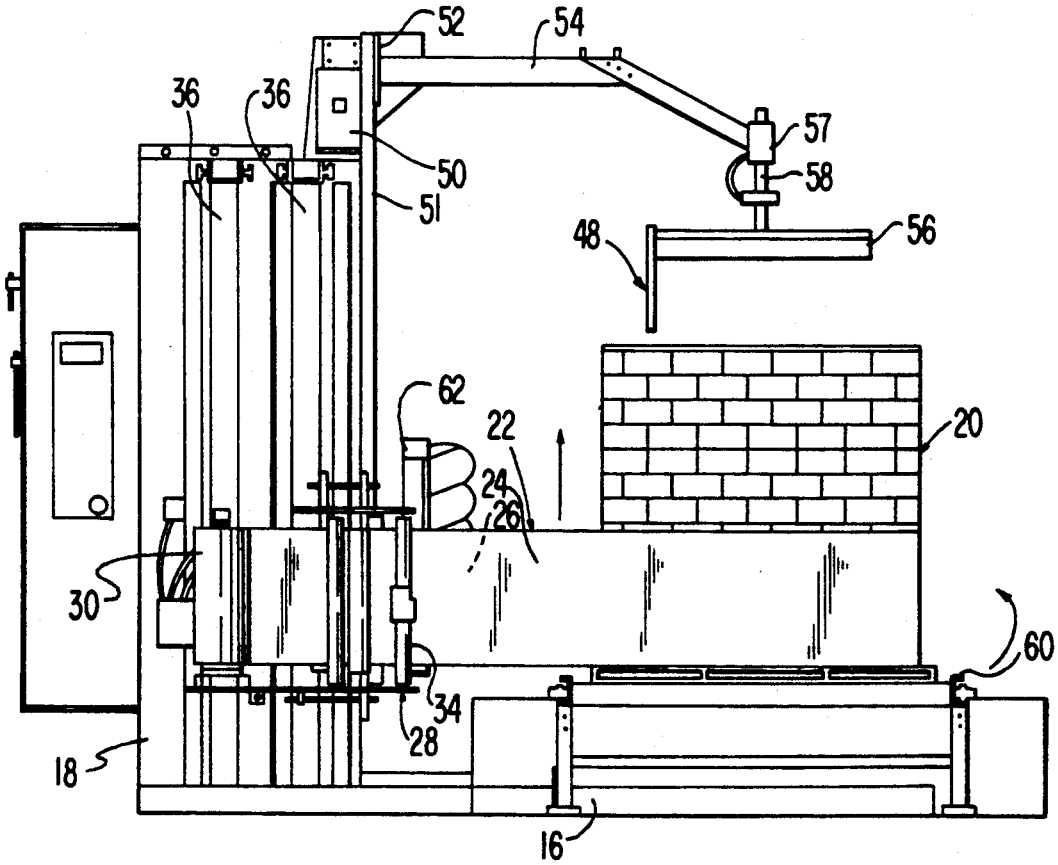
FIG. 1 is a side view of a first embodiment of the invention.
Figure 3:
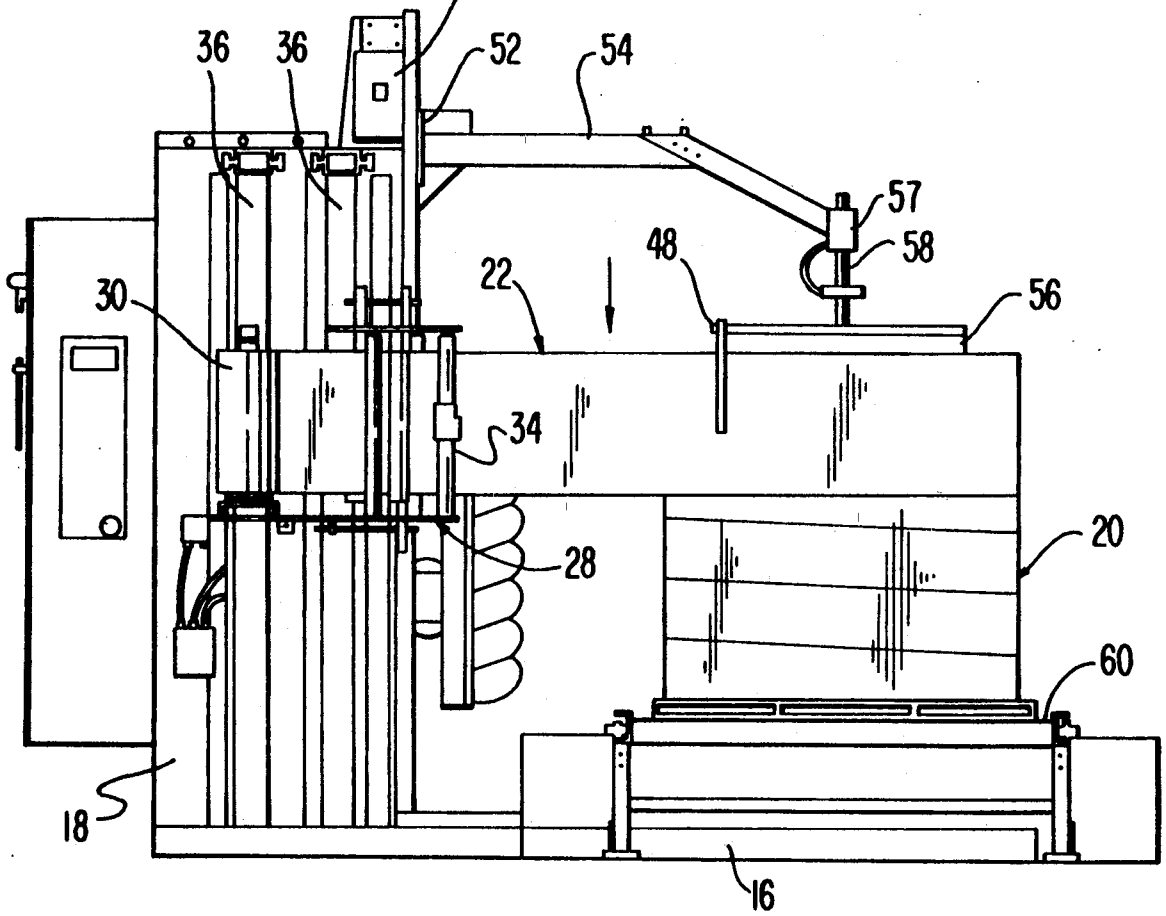
FIG. 3 is a side view of the embodiment of FIG. 1, showing the orientation of the components in a different stage of the stretch wrapping process.

In the first embodiment of the present invention shown in FIGS. 1-3, the load 20 is wrapped in the following manner. The load 20 is moved into the wrapping area by conveyor 60. A free end of the film web 22 is attached to the load 20 or a clamp on turntable 45. Preferably, the film web 22 is initially applied with a tacky surface of the film web 22 facing away from the load 20. The load 20 is rotated on turntable 45, pulling film web 22 out of roll carriage 28 and wrapping the film web around the load 20. As the film web 22 is being pulled out of roll carriage 28, it is stretched by the prestretch rollers 32 which are driven at different velocities.

Belts 36 are driven to move the roll carriage 28 in a vertical direction substantially parallel to the axis of rotation of the load 20, thereby causing the film web 22 to wrap around the load 20 in a spiral pattern. Preferably, the edges of the film web 22 are overlapped to cause the tacky surface to adhere to the overlapped edges and thereby strengthen the package. Alternatively, a full width film web may be used.

When the load 20 has been covered with film web 22 the rotation of the load 20 is stopped. Belt 52 is driven by motor 50, causing platen 56 to descend and contact the top of load 20. The restraining member 48 is thereby positioned adjacent the tacky surface 24 and in the path of the film web 22. The load 20 is then rotated in the reverse direction. Platen 56 remains in contact with the top of load 20 and therefore the platen 56 and restraining member 48 are rotated in unison with the load 20.

Figure 5:
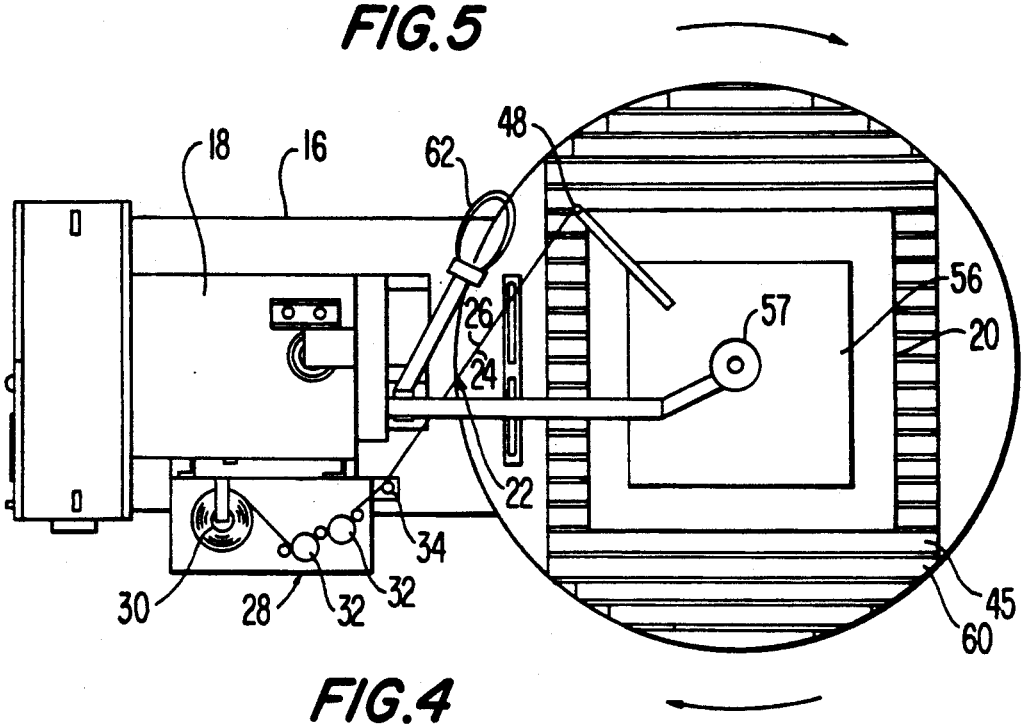
FIG. 5 is a plan view of the embodiment of FIG. 1, showing the orientation of the components in a different stage of the stretch wrapping process.
Figure 4:
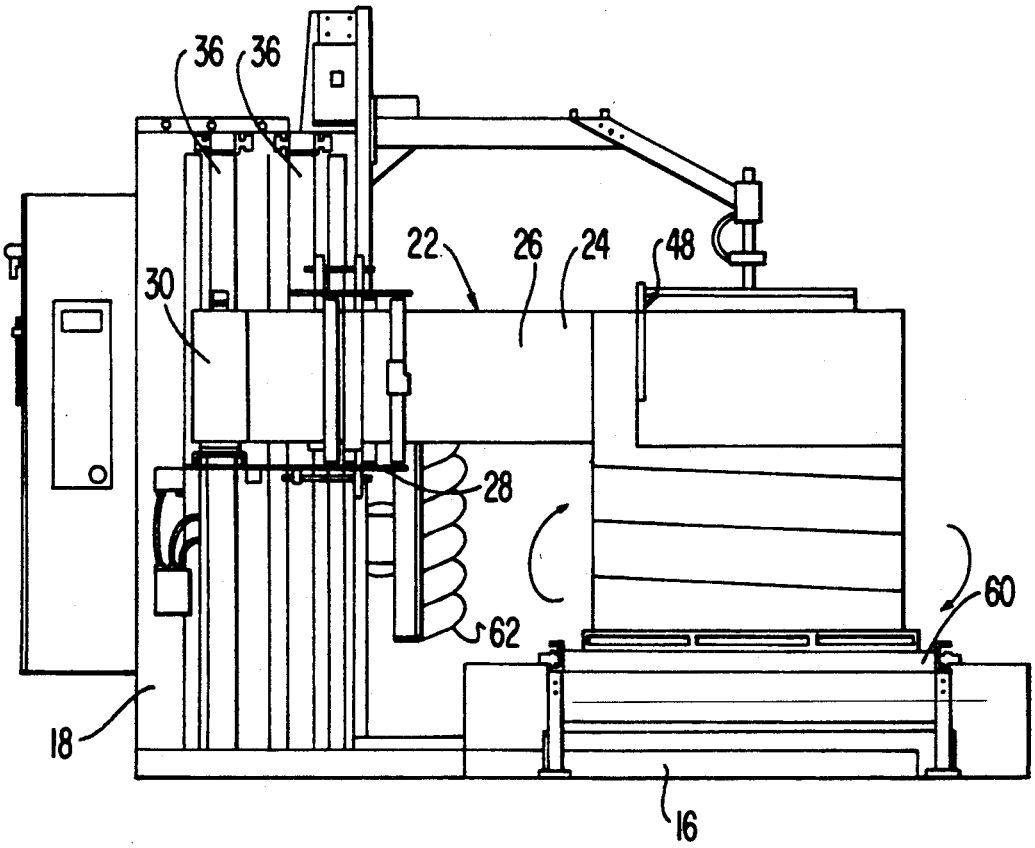
FIG. 4 is a side view of the embodiment of FIG. 1, showing the orientation of the components in a different stage of the stretch wrapping process.
Figure 6:
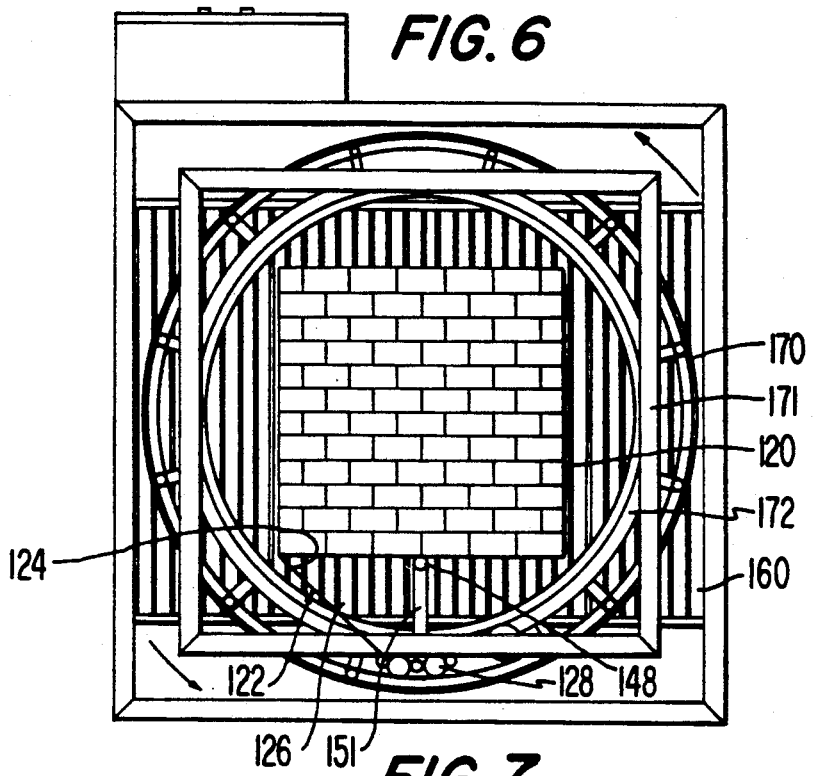
FIG. 6 is a plan view of a second embodiment of the present invention.

As shown in FIG. 5, the restraining member 48 restrains the film web 22, causing the film web 22 to wrap around the restraining member 48 and fold back on itself. The orientation of the film web 22 is reversed. The tacky surface of the film web 22 being dispensed now faces toward the load 20 and the non-tacky surface 26 faces away from the load 20. The film web 22 is continuously wrapped around the load 20 while roll carriage 28 is moved in a vertical direction substantially parallel to the axis of rotation of the load until the entire height of the sides of load 20 is covered. The restraining member 48 is removed from the fold in the film web 22 by actuating the motor 50 to drive the belt 52, lifting the platen 56 and restraining member 48.

The film web 22 is then severed and the wipe down mechanism 62 is extended toward the load 20 to press the trailing end of the wrapped film web 22 against the load 20 and cause it to adhere to the load 20. The load 20 is conveyed out of the wrapping area. A package is produced having a non-tacky surface contacting the load 20 and also forming the outside surface of the package.

FIGS. 6–9 show a second embodiment of the present invention. In the second embodiment, the load 120 remains stationary while the roll carriage 128 revolves around the load 120 and also moves in a direction substantially parallel to its own axis of revolution. As embodied herein, the means for rotating the load 120 relative to the dispensing means includes a track 170 mounted on a frame 171 supported within a stanchion 118, and a rotatable ring 172 supported and guided by track 170. The roll carriage 128 is mounted on the ring 172, and ring 172 is driven to rotate by a motor. Another example of this type of machine is shown in U.S. Pat. No. 4,587,796 which is incorporated herein by reference.

Figure 7:
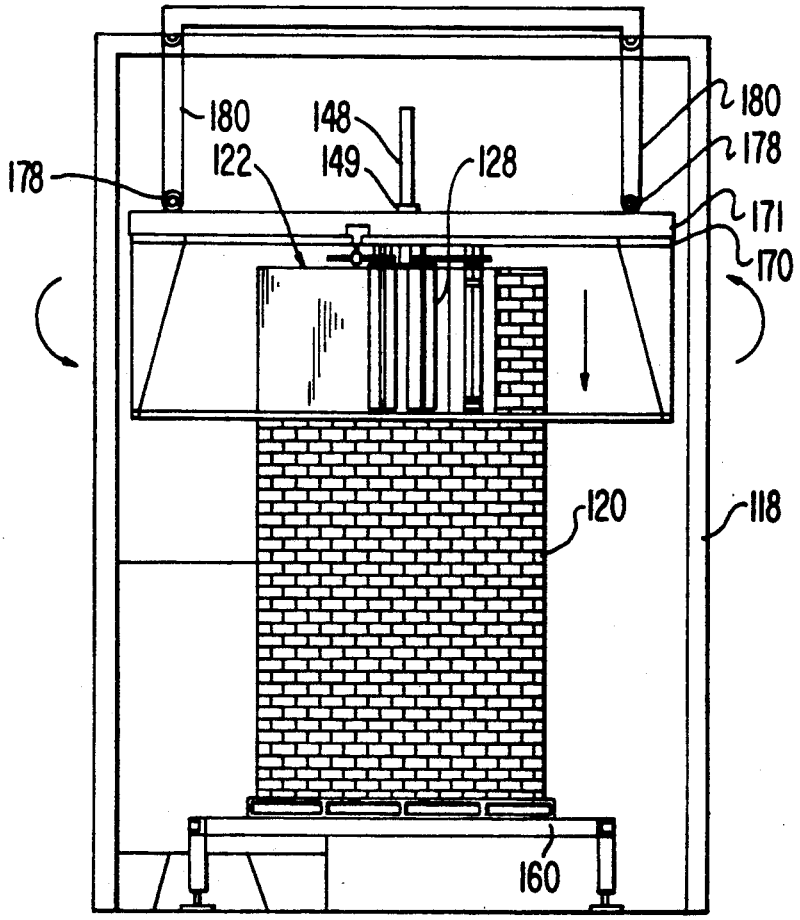
FIG. 7 is a side view of the embodiment of FIG. 6.
Figure 8:
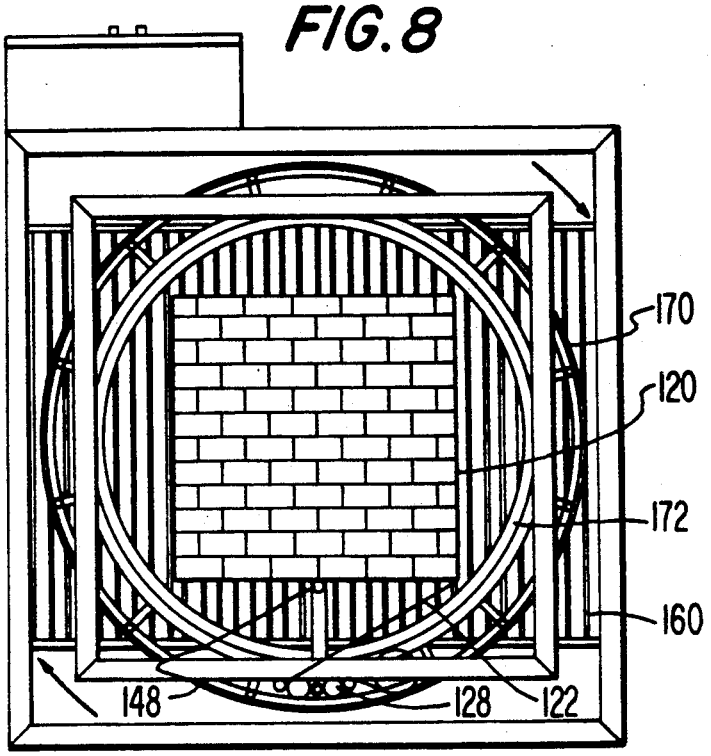
FIG. 8 is a plan view of the embodiment of FIG. 6, showing the orientation of the components in a different stage of the stretch wrapping process.
Figure 9:
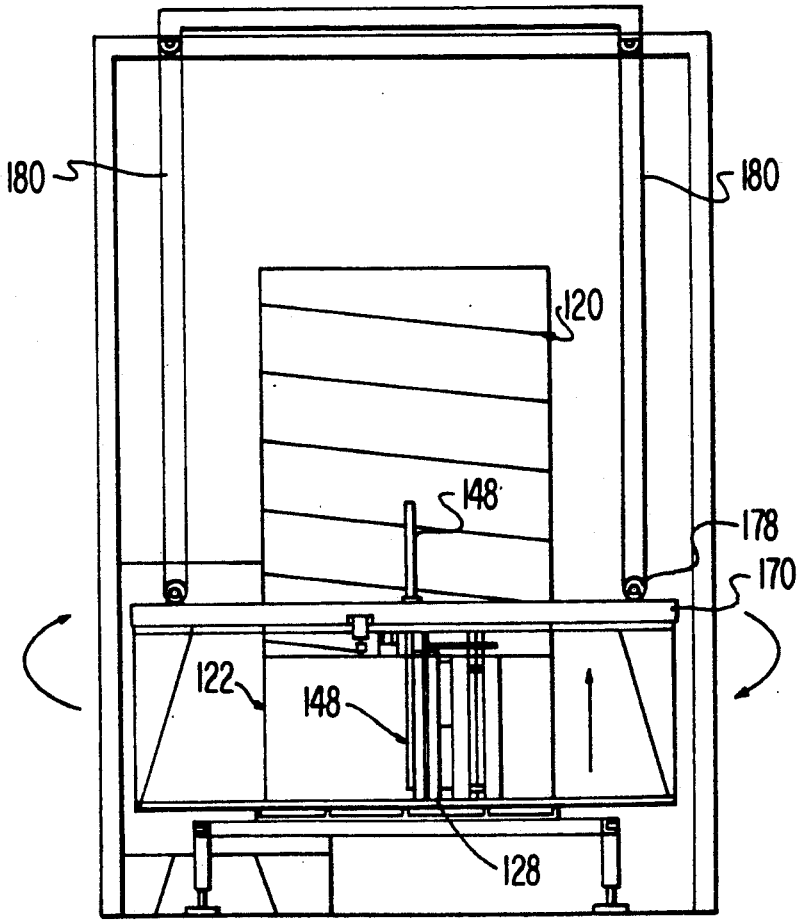
FIG. 9 is a side view of the embodiment of FIG. 6, showing the orientation of the components in a different stage of the stretch wrapping process.
Figure 10:
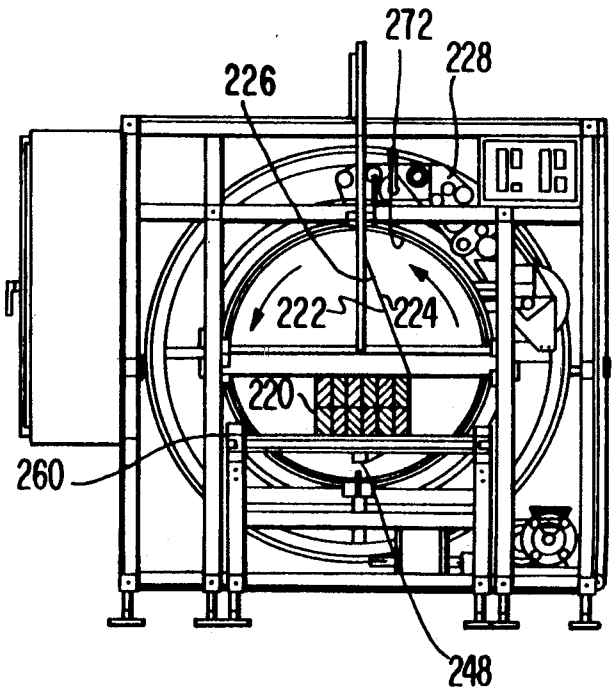
FIG. 10 is a side view of a third embodiment of the present invention.
Figure 11:
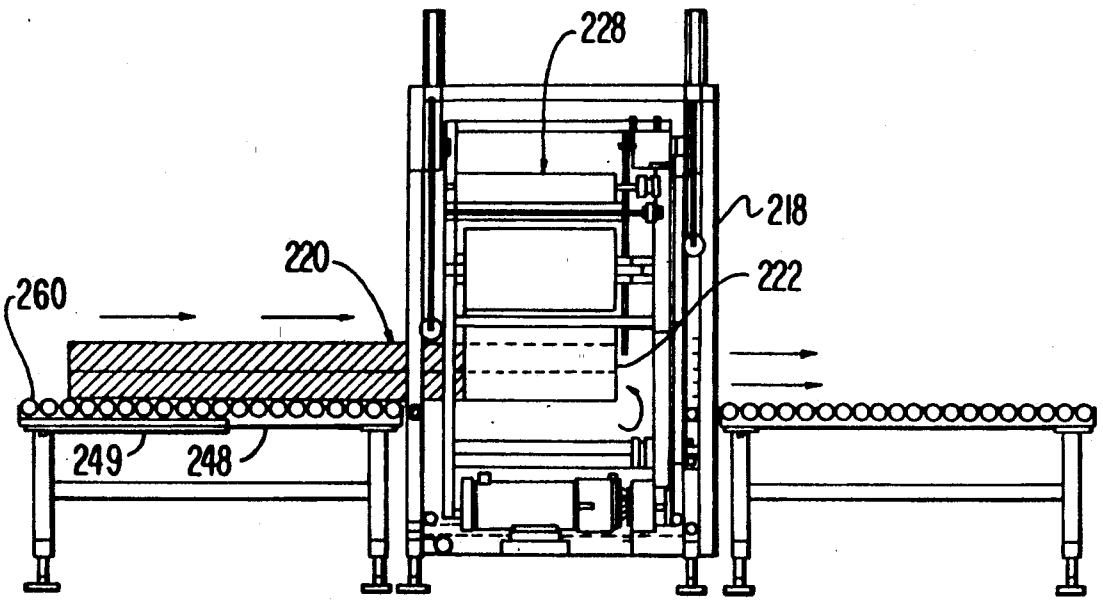
FIG. 11 is a side view of the embodiment of FIG. 10.
Figure 12:
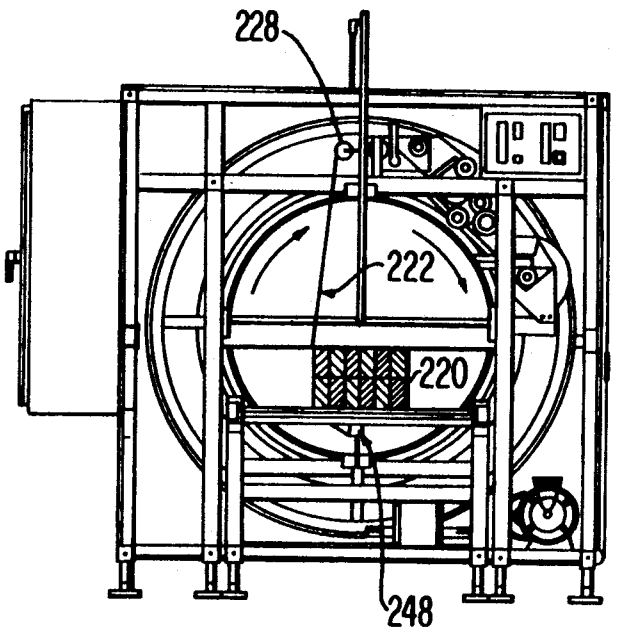
FIG. 12 is a side view of the embodiment of FIG. 10, showing the orientation of the components in a different stage of the stretch wrapping process.
Figure 13:
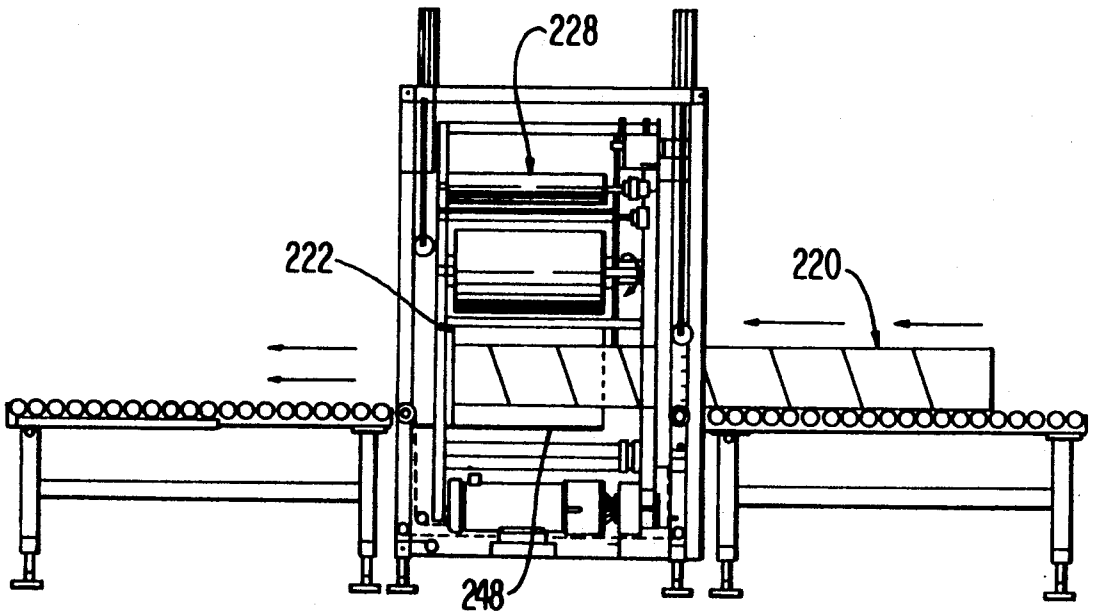
FIG. 13 is a side view of the embodiment of FIG. 10, showing the orientation of the components in a different stage of the stretch wrapping process.

In this embodiment, the means for dispensing the film web 122 onto the load 120 includes a roll carriage 128 that is substantially the same as the roll carriage 28 described above in relation to the first embodiment of the invention. Means are provided for moving the dispensing means in a direction substantially parallel to its own axis of revolution. As shown in FIG. 7, the means includes pulleys 178 mounted on frame 171, wires 180 extending about the pulleys 178, and a motor and winch which move wires 180 for raising and lowering frame 171 and track 170.

As embodied herein, the restraining means comprises a restraining member 148 for engaging the surface of the film web 122 which faces away from the load 120 and means for selectively positioning the restraining member 148 adjacent the surface of the film web 122 which faces away from the load 120. Restraining member 148 is preferably a metal rod which extends in a vertical direction substantially perpendicular to the dispensing direction of the film web 122.

As embodied herein, the means for selectively positioning the restraining member 148 comprises a rodless cylinder 149 mounted on frame 171 which selectively positions the restraining member 148 in a vertical direction. A second rodless cylinder 151 may be used to position restraining member 148 in the horizontal direction.

The second embodiment of the present invention operates in the following manner. The load 120 is conveyed into the wrapping area by the conveyor 160. An end of the film web 122 is attached to the load 120 with the tacky surface 124 facing away from the load 120. The ring 172 with roll carriage 128 is revolved around the load 120 while the load 120 remains stationary. Film web 122 is pulled off of the film web supply roll 130, through the stretch rollers 132, over the guide roller 134, and wrapped onto the load 120. The prestretch rollers 132 stretch the film web 122 as it is applied to the load 120. As the film web 122 is wrapped around the load 120, the Winch moves frame 171, track 170, ring 182 and roll carriage 182 in a direction substantially parallel to its own axis of revolution to wrap the film web 122 around the load 120 in a spiral pattern.

After the film web 122 has covered the entire load 120, the restraining member 148 is inserted in the path of film web 122 by actuating rodless cylinder 149 to move restraining member 148 vertically downward. Then ring 172 with roll carriage 128 is revolved around the load 120 in the reverse direction, thereby causing the film web 122 to fold back on itself about restraining member 148. The tacky surface 124 of the film web 122 is now facing toward the load 120 and the non-tacky surface 126 is facing away from the load 120. After the film web 122 has been wrapped around the load 120 and back over the folded portion, the restraining member 148 is removed from the fold in the film web 122 by actuating rodless cylinder 149 to move restraining member 148 vertically upward. Ring 172 with roll carriage 128 continues to revolve around the load 120 in the reverse direction and moves in a vertical direction substantially parallel to its own axis of revolution to apply the film web 122 over the entire load 120. The film web 122 is then severed and the trailing end is wiped down on the load 120. The load 120 is then conveyed out of the wrapping area.

The present invention also can be present in a stretch wrapping machine having a roll carriage revolving around a horizontal axis. A third embodiment of the invention is shown in FIGS. 10–13. In this embodiment, the film web 222 is wrapped around the load 220 as the load 220 is conveyed through the wrapping area. Another example of this type of machine generally is shown in U.S. Pat. No. 4,866,909 which is incorporated herein by reference.

In this embodiment, the means for dispensing the film web 222 onto the load 220 includes a roll carriage 228 attached to ring 272 which rotates about supporting track 270. The mean for moving the load 220 relative to the dispensing means includes a motor which drives ring 272 to rotate about the load.

As embodied herein, the restraining means comprises a restraining member 248 for engaging the surface of the film web 222 which faces away from the load 220 and means for selectively positioning the restraining member 248 adjacent the surface of the film web 222 which faces away from the load 220. The restraining member 248 is preferably a metal rod which extends in a direction substantially perpendicular to the dispensing direction of the film web 222. As embodied herein, the means for selectively positioning the restraining member 248 comprises a rodless cylinder 249 which selectively moves restraining member 248 in a horizontal direction.

The apparatus of the third embodiment of the present invention operates in the following manner. As the load 220 is conveyed into the wrapping area, ring 272 with roll carriage 228 revolves around the load 220. Film web 222 is pulled from film web supply roll 230, through stretch rollers 232, over guide roller 234, and applied to the load 220. The load 220 is moved through the wrapping area until the load 220 is covered with film web 222.

Once the load 220 is entirely wrapped, the restraining member 248 is horizontally extended into the path of the film web 222 by rodless cylinder 249, and positioned adjacent to the tacky surface 224 of the film web 222. The dispensing means is revolved around the load 220 in the reverse direction, wrapping the film web 222 around the restraining member 24 and causing the film web 222 to fold back on itself. The tacky surface 224 of the film web 222 is now facing toward the load and the non-tacky surface 226 is facing away from the load.

After the film web 222 has been wrapped around the load 220 and back over the folded portion, the restraining member 248 is removed from the fold by actuating rodless cylinder 249. The load 220 is conveyed backwards and the film web 222 is continuously wrapped around the load 220 until the entire outer surface of the load 220 is covered. The film web 222 is then severed and the severed end is wiped down on the load 220. The load 220 is conveyed out of the wrapping area.

It will be apparent to those skilled in the art that various modifications and variations can be made in the disclosed embodiments of the present invention without departing from the scope or spirit of the invention. For example, the present invention ca be applied to other stretch wrapping methods and apparatus. Additionally, two restraining members can be inserted into the path of the film web from opposing sides of the film web instead of using just one restraining member, and restraining members of various configurations may be used.

Furthermore, the load does not have to be completely wrapped with film web before the restraining member is removed from the fold in the film web. The restraining member can be removed from the fold as soon as the fold is sufficiently adhered to the load to inhibit the fold from falling away from the load.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of stretch wrapping a load, comprising the steps of:

wrapping a film web around the load in a fist rotational direction with a first side of the film web facing away from the load;

restraining the film web so that the film web is reversed on itself and wrapped around the load in a second rotational direction when the wrapping direction is reversed;

wrapping the film web around the load in the second rotational direction with the first side of the film web facing toward the load.

2. The method of claim 1 wherein the restraining step includes inserting a restraining member into the path of the film web at a position adjacent to the first side of the film web prior to wrapping the film web around the load in the second rotational direction, the film web being wrapped around and restrained by the restraining member when the film web is wrapped around the load in the second rotational direction.

3. The method of claim 2 wherein the step of inserting the restraining member includes moving the restraining member generally parallel to the axes of the first and second rotational directions.

4. The method of claim 2 wherein the film web is wrapped around the load by rotating the load, and the restraining member is rotated in unison with the load during the restraining step.

5. A method for wrapping a load with a film web having a tacky surface and a non-tacky surface, comprising the steps of:

wrapping the film web around the load in a first rotational direction with the tacky surface of the film web facing away from the load;

restraining the film web so that the film web is reversed on itself and wrapped around the load in a second rotational direction when the wrapping direction is reversed;

wrapping the film web around the load in the second rotational direction with the tacky surface of the film web facing toward the load.

6. The method of claim 5 wherein the film web is wrapped around the load in the second rotational direction until the film web with the tacky surface facing toward the load has covered the film web which was wrapped with the tacky surface facing away from the load.

7. The method of claim 5 wherein the restraining step includes inserting a restraining member into the path of the film web at a position adjacent the tacky surface of the film web and wrapping the film web around the restraining member, prior to wrapping the film web around the load in the second rotational direction.

8. The method of claim 7 wherein the step of inserting the restraining member includes moving the restraining member generally parallel to the axes of the first and second rotational directions.

9. The method of claim 7 wherein the film web is wrapped around the load by rotating the load, and the restraining member is rotated in unison with the load during the restraining step.

10. An apparatus for stretch wrapping a load, comprising:

means for dispensing a film web onto the load;

means for moving the load relative to the dispensing means in a first rotational direction or wrapping the film web around the load with a first side of the film web facing away from the load and a second rotational direction, opposite to the first direction, for wrapping the film web around the load with the first side of the film web facing toward the load;

means for restraining the film web after the film web has been wrapped around the load in the first rotational direction so that the film web is reversed on itself when the film web is wrapped around the load in the second rotational direction.

11. The apparatus of claim 10 wherein the restraining means includes a restraining member for selectively engaging the first side of the film web and means for selectively positioning the restraining member adjacent the first side of the film web.

12. The apparatus of claim 11 wherein the means for selectively positioning the restraining member conveys the restraining member in a direction generally parallel to the axes of the first and second rotational directions.

13. The apparatus of claim 11 wherein the means for moving the load rotates the load and the restraining member in unison with the load when the film web is restrained by the restraining member.

14. The apparatus of claim 11 wherein the restraining member includes a rod extending in a direction generally parallel to the axis of the rotational directions.

15. The apparatus of claim 10 further comprising a top platen assembly for engaging the top of the load, the restraining means including a restraining member extending downward from the top platen assembly for selectively engaging the first side of the film web.

16. The apparatus of claim 11 further comprising a top platen assembly for engaging the top of the load, the restraining member extending downward from the top platen assembly for selectively engaging the first side of the film web.

* * * * *

UNITED STATES PATENT AND TRADEMARK OFFICE

CERTIFICATE OF CORRECTION

PATENT NO. : 5,155,970

DATED : October 20, 1992

INVENTOR(S) : Phil Moore

It is certified that error appears in the above-identified patent and that said Letters Patent is hereby corrected as shown below:

Claim 1, column 7, line 29, "fist" should read --first--.

Signed and Sealed this

Twelfth Day of October, 1993

*Attest:*

*Attesting Officer*

Bruce Lehman

BRUCE LEHMAN

*Commissioner of Patents and Trademarks*